US009655224B2

(12) United States Patent
Jung et al.

(10) Patent No.: US 9,655,224 B2
(45) Date of Patent: May 16, 2017

(54) PLASMA GENERATION ELECTRODE MODULE, PLASMA GENERATION ELECTRODE ASSEMBLY, AND APPARATUS FOR GENERATING PLASMA USING THE SAME

(71) Applicants: Heesoo Jung, Daejeon (KR); Haewan Lee, Daejeon (KR)

(72) Inventors: Heesoo Jung, Daejeon (KR); Haewan Lee, Daejeon (KR)

(73) Assignee: AGENCY FOR DEFENSE DVELOPMENT, Daejeon (KR)

( * ) Notice: Subject to any disclaimer, the term of this patent is extended or adjusted under 35 U.S.C. 154(b) by 0 days.

(21) Appl. No.: 14/926,096

(22) Filed: Oct. 29, 2015

(65) Prior Publication Data

US 2016/0262251 A1 Sep. 8, 2016

(30) Foreign Application Priority Data

Mar. 5, 2015 (KR) ..... 10-2015-0031210

(51) Int. Cl.
*H05H 1/24* (2006.01)

(52) U.S. Cl.
CPC ..... *H05H 1/24* (2013.01); *H05H 1/2406* (2013.01); *H05H 2001/2412* (2013.01)

(58) Field of Classification Search
CPC ..... H01J 37/32541; H05H 1/2406; H05H 2001/2418; Y10T 29/49204; C23C 16/52; C23C 16/401; C23C 16/45546; C23C 16/56; C23C 16/30; C23C 16/45525; C23C 16/45542; C23C 16/45578; C23C 16/4584; C23C 16/511; C23C 16/513; C23C 18/1637; C23C 14/35; C23C 14/352

See application file for complete search history.

(56) References Cited

U.S. PATENT DOCUMENTS 3,865,733 A 2/1975 Taylor
2008/0131333 A1 6/2008 Tzeng et al.
(Continued)

FOREIGN PATENT DOCUMENTS

DE 19546355 A1 6/1996
DE 69130110 T2 3/1999
(Continued)

*Primary Examiner* — Monica C King
(74) *Attorney, Agent, or Firm* — Scully, Scott, Murphy & Presser, PC

(57) ABSTRACT

A plasma generation electrode module includes: a plasma generation electrode module includes: first and second electrodes formed to be spaced apart from one another; and a dielectric disposed between the first and second electrodes to insulate the first and second electrodes, wherein the first electrode has a shaft shape, a first cylindrical dielectric is formed to be in concentric with the first electrode so as to be in contact with an outer circumference of the first electrode and cover the first electrode, and the second electrode is formed to be in concentric with the first dielectric so as to be in contact with an outer circumference of the first dielectric and cover the first dielectric, wherein a plurality of through holes are disposed on the second electrode, wherein the first and second electrodes are formed to be woven.

17 Claims, 9 Drawing Sheets

(56) References Cited

U.S. PATENT DOCUMENTS

| | | | | |
|---|---|---|---|---|
| 2008/0170982 | A1* | 7/2008 | Zhang | B82Y 10/00 423/447.3 |
| 2012/0098545 | A1* | 4/2012 | Son | H01J 37/32917 324/464 |
| 2012/0271225 | A1* | 10/2012 | Stieber | A61B 18/042 604/26 |
| 2016/0030622 | A1* | 2/2016 | Li | A61L 9/22 422/122 |
| 2016/0151774 | A1* | 6/2016 | Fukumura | C23C 14/0688 502/5 |

FOREIGN PATENT DOCUMENTS

| | | | |
|---|---|---|---|
| DE | 10007130 | C1 | 5/2001 |
| DE | 10127035 | A1 | 2/2002 |
| DE | 10316378 | B3 | 7/2004 |
| JP | 2008130343 | A | 6/2008 |
| KR | 10-145778 | | 10/2014 |
| KR | 101454778 | B1 * | 10/2014 |

* cited by examiner

PLASMA GENERATION ELECTRODE MODULE, PLASMA GENERATION ELECTRODE ASSEMBLY, AND APPARATUS FOR GENERATING PLASMA USING THE SAME

CROSS-REFERENCE TO RELATED APPLICATION

Pursuant to 35 U.S.C. §119(a), this application claims the benefit of earlier filing date and rights of priority to Korean Application No. 10-2015-0031210, filed on Mar. 5, 2015 the contents of which is incorporated by reference herein in its entirety.

BACKGROUND OF THE INVENTION

1. Field of the Invention

The present disclosure relates to a plasma generation electrode module using a flexible electrode, a plasma generation electrode assembly, and an apparatus for generating plasma (or a plasma generating apparatus) using the same, and particularly, to a technique of generating plasma in the atmosphere without supplying an external gas.

2. Background of the Invention

Unlike vacuum plasma used in a semiconductor process, or the like, atmospheric pressure plasma discharged in an open space (1 atm) has been actively researched since 1990s. Atmospheric pressure plasma are variously classified into dielectric barrier discharge (DBD), corona jet, glow discharge, arc torch, micro-hollow cathode discharge (MHCD), inductively coupled plasma (ICP), and the like, according to discharge structures and discharge modes. Here, plasma having physical/chemical characteristics may be generated by adjusting an input frequency, an input voltage/current, an input waveform, a supply gas, and the like. Due to various characteristics, research into applications of atmospheric pressure plasma to various fields such as bio/medical industry, material industry, energy/environment industry, as well as basic research of atmospheric pressure plasma, have been actively conducted worldwide.

When a high voltage is applied between two electrodes disposed to be spaced apart from one another, discharge is made in the space between the two electrodes, ionizing a reactive gas to form plasma. The plasma formed thusly includes numerous functional ions capable of modifying a surface of a material by removing fine foreign objects, changing surface roughness, and forming a polar functional group, as well as cleaning the surface of the material, to enhance adhesion in the event of printing, coating, and bonding.

However, research into small DBD or corona jet type plasma using a helium or argon gas having a relatively low discharge voltage, among the atmospheric pressure plasma, accounts for 90% or greater, and in this case, since a large amount of gas such as helium or argon supplied for discharge is consumed, supply gas facilities are additionally required, resulting in the necessary to simplify a system. In atmospheric pressure plasma using air, instead of discharge gas, DBD-type or torch-type electrode structures have been mostly studied, but since a space between electrodes is small or a plasma treatment sectional area is small, a new electrode performing large area discharge, while increasing power efficiency, is required.

Recently, in order to overcome the limitation in the treatment area, research into treatment of a surface of a flat large area by combining a plasma torch array and a roll-to-roll process has been conducted. However, in many cases, an overall plasma system is designed by using electrodes in a non-flexible electrode form to generate the aforementioned plasma. Thus, there is a limitation in the volume and design of the overall system due to the non-flexible electrodes in designing electrodes for various applications.

SUMMARY OF THE INVENTION

Therefore, an aspect of the detailed description is to provide an electrode, and an apparatus for generating plasma which can be manufactured in the form of a blanket.

Another aspect of the detailed description is for provide a method for rapidly and safely performing detoxification and sterilization, overcoming various shortcomings of a detoxification/sterilization system used in civil medical purpose or military.

To achieve these and other advantages and in accordance with the purpose of this specification, as embodied and broadly described herein, a plasma generation electrode module includes: first and second electrodes formed to be spaced apart from one another; and a dielectric disposed between the first and second electrodes to insulate the first and second electrodes, wherein the first electrode has a shaft shape, a first cylindrical dielectric is formed to be in concentric with the first electrode so as to be in contact with an outer circumference of the first electrode and cover the first electrode, and the second electrode is formed to be in concentric with the first dielectric so as to be in contact with an outer circumference of the first dielectric and cover the first dielectric, wherein a plurality of through holes are disposed on the second electrode, wherein the first and second electrodes are formed to be woven.

According to an aspect of the present disclosure, the first and second electrodes may be provided as conductive thin films.

According to an aspect of the present disclosure, a photocatalyst or an active catalyst may be coated on one or more of the first and second electrodes According to an aspect of the present disclosure, a second dielectric may be formed to be in concentric with the second electrode on an outer circumference of the second electrode so as to be in contact with the outer circumference of the second electrode, and may be formed of a member having air permeability.

To achieve these and other advantages and in accordance with the purpose of this specification, as embodied and broadly described herein, a plasma generation electrode assembly includes: first and second electrodes formed to be spaced apart from one another; and a dielectric disposed between the first and second electrodes to insulate the first and second electrodes, wherein the first electrode has a shaft shape, a first dielectric is formed to be in concentric with the first electrode to cover an outer circumference of the first electrode, the second electrode has a shaft shape and is interlaced with the first electrode, a second dielectric may be formed to be in concentric with the second electrode to cover an outer circumference of the second electrode, and the first and second dielectrics may be in contact with each other, and a plurality of through holes are formed in the first dielectric.

To achieve these and other advantages and in accordance with the purpose of this specification, as embodied and broadly described herein, a plasma generation electrode module includes: first and second electrodes formed to be spaced apart from one another; and a dielectric disposed between the first and second electrodes to insulate the first and second electrodes, wherein the first electrode has a circular cylindrical shape having a through hole, and the second electrode is a circular plate.

To achieve these and other advantages and in accordance with the purpose of this specification, as embodied and broadly described herein, a plasma generation electrode assembly includes: a plurality of unit plasma generation electrode modules including a first flexible electrode unit and a second flexible electrode unit, the first flexible electrode unit may include a first electrode having a shaft shape and a first dielectric formed to be in concentric with the first electrode so as to be in contact with an outer circumference of the first electrode and cover the first electrode, and the second flexible electrode unit may include a second electrode formed to be in concentric with the first dielectric so as to be in contact with an outer circumference of the first dielectric and cover the first dielectric, and having a plurality of through holes, wherein the first and second flexible electrode units are woven to be flexible.

According to an aspect of the present disclosure, a second dielectric may be formed to be in concentric with the second electrode on an outer circumference of the second electrode so as to be in contact with the outer circumference of the second electrode.

According to an aspect of the present disclosure, the second dielectric may be formed of a material having air permeability.

To achieve these and other advantages and in accordance with the purpose of this specification, as embodied and broadly described herein, a plasma generation electrode assembly includes: a first flexible electrode unit; a second flexible electrode unit formed to be spaced apart from the first flexible electrode unit, the first flexible electrode may include a first electrode having a shaft shape and a first dielectric formed be concentric with the first electrode to cover an outer circumference of the first electrode, the second flexible electrode may include a second electrode having a shaft shape and a second dielectric formed to be in concentric with the second electrode to cover an outer circumference of the second electrode, the first and second flexible electrode units may be disposed to interlace with each other, and a plurality of through holes may be formed in any one of the first dielectric and the second dielectric.

To achieve these and other advantages and in accordance with the purpose of this specification, as embodied and broadly described herein, a plasma generation electrode assembly includes: a first electrode; a second electrode formed to be spaced apart from the first electrode; and a plurality of unit plasma generation electrode modules including a dielectric disposed between the first electrode and the second electrode to insulate the first electrode and the second electrode, wherein the first electrode has a circular cylindrical shape with a through hole, the second electrode is a circular plate, and the plurality of unit plasma generation electrode modules are formed in a flexible member.

To achieve these and other advantages and in accordance with the purpose of this specification, as embodied and broadly described herein, a plasma generating apparatus may include: the foregoing plasma generation electrode assembly; a power supply unit configured to apply power to the first and second electrodes; and a plasma control unit configured to control active oxygen and active nitrogen included in plasma generated by the first and second electrodes.

According to an aspect of the present disclosure, the plasma generating apparatus may further include: a light source configured to irradiate ultraviolet rays.

According to an aspect of the present disclosure, a plasma diagnosing unit may be connected to the first and second electrodes to diagnose whether plasma is normally generated.

According to an aspect of the present disclosure, the plasma generating apparatus may further include: first and second covers disposed outside of the first and second electrodes, wherein a plurality of fine holes are formed on any one of the first and second covers.

According to an aspect of the present disclosure, an electromagnetic wave shielding grid shielding an electromagnetic wave may be attached to at least one of the first cover and the second cover.

According to an aspect of the present disclosure, the first and second dielectrics may be any one of Teflon, silicon, glass fiber and polyimide.

The atmospheric pressure plasma electrode structure and an application technique thereof according to the exemplary embodiments of the present disclosure may have the following advantages.

According to at least one of exemplary embodiments of the present disclosure, the flexible electrode structure and the detoxification blankets may detoxificate and sterilize materials having various shapes.

According to at least one of exemplary embodiments of the present disclosure, various dischargers may be easily deformed to be used using the flexible plasma generation electrode module.

According to at least one of exemplary embodiments of the present disclosure, atmospheric pressure plasma may be discharged without additionally supplying an external discharge gas.

At least one of the exemplary embodiments of the present disclosure may be applied to various detoxification and sterilization techniques including a change in properties of a material, a surface modification, a material synthesis, and cleaning in an environment cleanup technology, a medical and bioindustry technology, an energy and material industry, a processing industry, and a military weapon system, and the like.

At least one of the exemplary embodiments of the present disclosure may be applied to stealth techniques, or the like, in addition to the detoxification/sterilization technique by plasma generated on a surface of an electrode or a plasma generating apparatus.

Additional coverage of applicability of the present invention will become apparent from the following description of the embodiments which is set forth hereinafter. However, various modifications and equivalents within the concept and scope of the present invention may be clearly understood by a person skilled in the art, and detailed descriptions and specific embodiments of the present invention should be understood as being merely illustrative.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Figure 1:
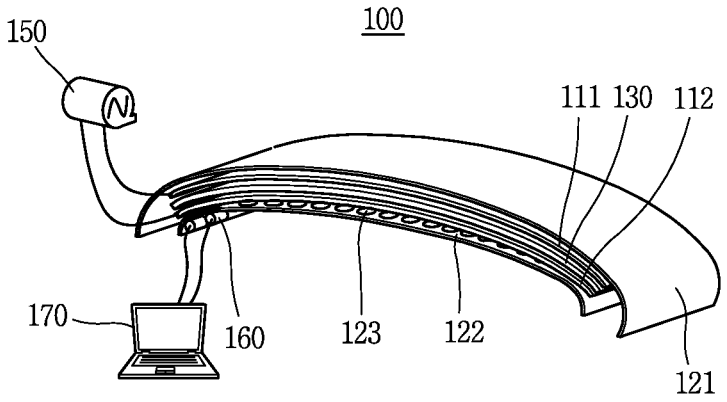
FIG. 1 is a schematic view illustrating a configuration of an apparatus for generating plasma including an electrode related to an exemplary embodiment of the present disclosure.

Hereinafter, the embodiments of the present invention will be described with reference to the accompanying drawings, in which like numbers refer to like elements throughout although the embodiments are different, and a description of the like elements a first embodiment will be used for those of the different embodiment. In the following description, usage of suffixes such as 'module', 'part' or 'unit' used for referring to elements is given merely to facilitate explanation of the present invention, without having any significant meaning by itself. In describing the present invention, if a detailed explanation for a related known function or construction is considered to unnecessarily divert the gist of the present invention, such explanation has been omitted but would be understood by those skilled in the art. The accompanying drawings of the present invention aim to facilitate understanding of the present invention and should not be construed as limited to the accompanying drawings. Also, the present invention is not limited to a specific disclosed form, but includes all modifications, equivalents, and substitutions without departing from the scope and spirit of the present invention.

It will be understood that, although the terms first, second, etc. may be used herein to describe various elements, these elements should not be limited by these terms. These terms are only used to distinguish one element from another.

It is to be understood that when one element is referred to as being "connected to" or "coupled to" another element, it may be connected directly to or coupled directly to another element or be connected to or coupled to another element, having the other element intervening therebetween. On the other hand, it is to be understood that when one element is referred to as being "connected directly to" or "coupled directly to" another element, it may be connected to or coupled to another element without the other element intervening therebetween.

As used herein, the singular forms "a", "an" and "the" are intended to include the plural forms as well, unless the context clearly indicates otherwise.

It will be further understood that the terms "comprises" "comprising," "includes" and/or "including" when used herein, specify the presence of stated features, integers, steps, operations, elements, and/or components, but do not preclude the presence or addition of one or more other features, steps, operations, elements, components, and/or groups thereof.

In an exemplary embodiment of the present disclosure, an electrode structure, which is able to cause discharge in the air or water without supplying a gas and which is flexible so as to be bent or spread, is designed, and a plasma generation electrode module including the designed electrode structure is provided.

Also, an additional system such as an air supply system or a discharge cover which is safe over a high voltage required for discharge and increases an effect of treating atmospheric pressure plasma is provided.

According to an exemplary embodiment of the present disclosure, atmospheric pressure plasma may be used according to a simple procedure and a complicated surface of an object may be treated, compared with the related art method.

Hereinafter, an electrode structure for discharging atmospheric pressure plasma and a configuration of an additional system will be described in detail with reference to the accompanying drawings.

First, FIG. 1 is a schematic view illustrating a configuration of a plasma generating apparatus 100 including an electrode related to an exemplary embodiment of the present disclosure. Referring to FIG. 1, a plasma generation electrode module according to exemplary embodiment of the present disclosure includes first and second electrodes 111 and 112 formed to be spaced apart from one another, and a dielectric material (or a dielectric) 130 disposed between the first and second electrodes 111 and 112 to insulate the first and second electrodes 111 and 112.

The dielectric materials 130, 131, and 132 according to an exemplary embodiment of the present disclosure may be any one of Teflon, silicon, glass fiber and polyimide. As the silicon, heat-proof silicon properly tolerating high temperature may be used.

Here, the first electrode 111, the second electrode 112, and the dielectric material 130 are formed of a flexible material.

In an exemplary embodiment of the present disclosure, unit plasma generation electrode modules M1, M2, M3, and M4 for generating plasma may be formed, and plasma generation electrode assemblies A1, A21, A22, A3, and A4 may be formed by weaving a plurality of unit plasma generation electrode modules M1, M2, M3, and M4, respectively, and here, the plasma generation electrode assemblies A1, A21, A22, A3, and A4 formed by weaving the unit plasma generation electrode modules M1, M2, M3, and M4 may be flexible in itself.

That is, in the unit plasma generation electrode modules M1, M2, M3, and M4 according to an exemplary embodiment of the present disclosure, the first and second electrodes 111 and 112 and the dielectric material 130 are preferably formed of a flexible material, and when the unit plasma generation electrode modules M1, M2, M3, and M4 are used to form the plasma generation electrode assemblies A1, A21, A22, A3, and A4, the first and second electrodes 111 and 112 and the dielectric material 130 may not necessarily be flexible and the plasma generation electrode assemblies A1, A21, A22, A3, and A4 may have flexible qualities through weaving of the unit plasma generation electrode modules M1, M2, M3, and M4.

Here, in order to allow the first and second electrodes 111 and 112 to be flexible, the first and second electrodes 111 and 112 may be formed as thin films. Also, the first electrode 111 and the second electrode 112 are formed as conductive thin films having strong corrosion resistance.

Since the unit plasma generation electrode modules M1, M2, M3, and M4 and the plasma generation electrode assemblies A1, A21, A22, A3, and A4 are formed to be flexible, a discharge using the unit plasma generation electrode modules M1, M2, M3, and M4 and the plasma generation electrode assemblies A1, A21, A22, A3, and A4 may be easily deformed variously so as to be used.

In FIG. 1, it is illustrated that the first and second electrodes 111 and 112 and the first and second dielectric materials 131 and 132 have a planar or curved plate shape, but as described hereinafter, the first and second electrodes 111 and 112 and the first and second dielectric materials 131 and 132 may not necessarily have a plate shape.

Figure 2:
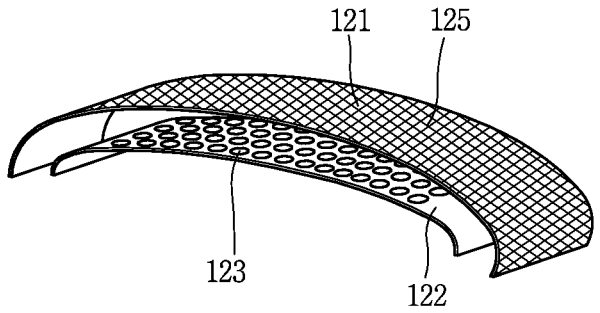
FIG. 2 is a schematic view of a cover of FIG. 1.

FIG. 2 is a schematic view of a cover of FIG. 1. Referring to FIGS. 1 and 2, the plasma generation electrode module further includes first and second covers 121 and 122 disposed on outer side of the first and second electrodes 111 and 112.

Fine holes 123 may be formed in the first cover 121 (and/or in the second cover 122), and an electromagnetic wave shielding grid 125 for blocking an electromagnetic wave may be attached to the second cover 122 (and/or to the first cover 121) to block an electromagnetic wave. Here, the electromagnetic wave shielding grid 125 is formed on an inner surface or an outer surface of the first cover 121 (and/or the second cover 121).

Also, a photocatalyst or an active catalyst are coated on one or more of the first electrode 111, the second electrode 112, the first cover 121, and the second cover 122 to obtain a synergy effect due to plasma, that is, to generate a large amount of active oxygen species.

The photocatalyst may be metal oxide, for example, the metal oxide may be one or more of $Al_2O_3$, $TiO_2$, ZnO, and $ZrO_2$.

The plasma generating apparatus 100 according to an exemplary embodiment of the present disclosure may include the first and second electrodes 111 and 112, the first and second covers 121 and 122 as detoxificating blankets, a plasma diagnosing unit 170, a power supply unit 150 supplying power to the electrodes, and additional modules for monitoring the plasma diagnosing unit 170.

Here, the first and second covers 121 and 122 are not essential elements but required for smooth detoxification and sterilization.

The components excluding the power supply unit 150 for generating plasma and a computer control unit for performing monitoring will be described.

The plasma generation electrode module may have a structure including the dielectric material 130 formed between the electrodes, the same as that of a related art plasma discharger, or may use a novel type electrode.

Here, the electrodes 111 and 112 and the dielectric material 130 may be formed of a material which has flexible characteristics and is electrically stable. In this case, however, in an exemplary embodiment of the present disclosure, the electrodes 111 and 112 and the dielectric material 130 are not necessarily be flexible. That is, as mentioned above, it is good enough for the electrodes 111 and 112 and the dielectric material 130 to be sufficiently small and arranged to make an assembly of the flexible plasma generation electrode modules flexible. As long as the electrode assembly generating plasma is flexible, the electrodes 111 and 112 and the dielectric material 130 may not necessarily be flexible.

That is, the electrodes 111 and 112 and the dielectric materials 130 having a small size may be flexible, or when a plurality of electrodes 111 and 112 and the dielectric materials 130 are arranged to form an assembly, the assembly need to be flexible.

A detailed structure of the first and second covers 121 and 122 is illustrated in FIG. 2.

In order to allow a sample, which is to be treated using discharged plasma, to react with active chemical species (for example, oxygen or nitrogen) for a sufficient period of time, the detoxificating blankets covering the first and second electrodes 111 and 112 have a structure in which one surface thereof has permeability and the other surface thereof have impermeability. To this end, any one of the first cover 121 and the second cover 122 includes a plurality of fine holes 123.

The reason for forming the plurality of fine holes 123 is to allow generated plasma to pass therethrough so as to be easily in contact with a surface of an object to be treated. That is, the plasma generated by the plasma generating apparatus 100 may be easily introduced to a sample provided outside through the fine holes 123.

In FIG. 1, an example of the plasma generating apparatus 100 is illustrated, and a plasma generation electrode module according to an exemplary embodiment of the present disclosure may be realized in various forms. This will be described with reference to FIGS. 3A through 6B hereinafter.

First, as illustrated in FIGS. 3A through 4D, the plasma generation electrode assemblies A1, A21, and A22 according to exemplary embodiments of the present disclosure include first flexible electrode units M1 and M21 and second flexible electrode units M1 and M22. The first and second flexible electrode units M1, M21, and M22 are spirally interlaced to form one body, or the first and second flexible electrode units M1, M21, and M22 may be vertically woven.

Figure 3A:
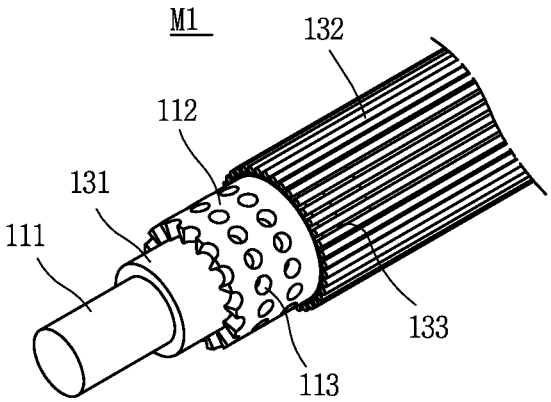
FIG. 3A is a partial schematic view of a unit plasma generation electrode module according to an exemplary embodiment of the present disclosure.
Figure 3B:
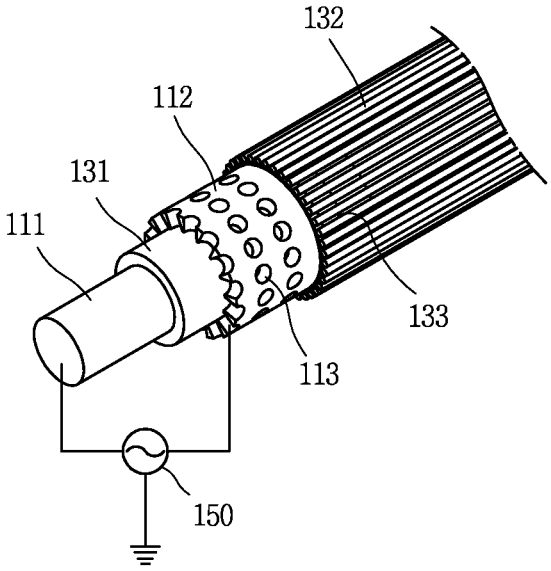
FIG. 3B is a view illustrating generation of plasma using the unit plasma generation electrode module of FIG. 3A.

FIG. 3A is a partial schematic view of the unit plasma generation electrode module M1 according to an exemplary embodiment of the present disclosure, and FIG. 3B is a view illustrating generation of plasma using the unit plasma generation electrode module M1 of FIG. 3A.

Referring to FIGS. 3A and 3B, the first electrode 111 has a shaft shape, the first dielectric material 131 is disposed on an outer circumference of the first electrode 111, the second electrode 112 is disposed to surround an outer circumference of the first dielectric material 131, and a plurality of through holes 113 are formed on the second electrode 112.

The through holes 113 are formed on the second electrode 112 to emit generated plasma outwardly. The second dielectric material 132 surrounding an outer circumference of the second electrode 112 may be disposed, and in this case, through holes 133 may be formed on the second dielectric material 132 to emit plasma outwardly. That is, the second dielectric material 132 is formed as a member having air permeability. In this case, the second dielectric material 132 serves as a cover like the cover 122 (please refer to FIG. 2), and the through holes 133 may be understood as fine holes 123 (please refer to FIG. 2) formed on the cover 122.

Figure 3C:
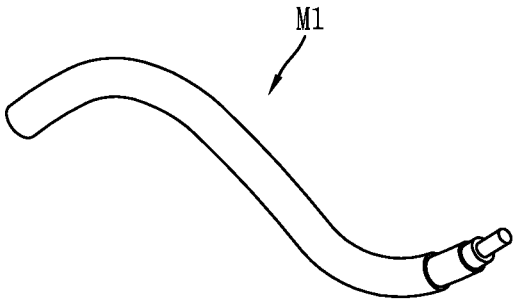
FIG. 3C is an overall schematic view of a unit plasma generation electrode module.

In FIG. 3C, the through holes 133 formed on the second dielectric material 132 may be formed as a mesh type. For example, the through holes 133 may be formed as glass fiber.

Figure 3D:
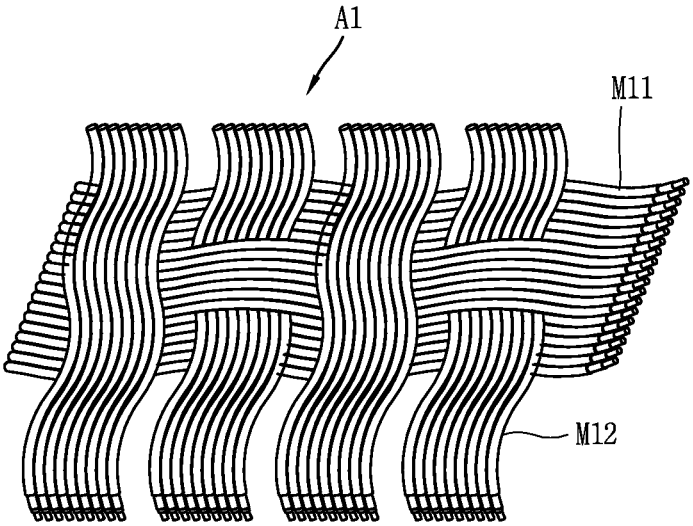
FIG. 3D is a schematic view of a plasma generation electrode assembly formed by unit plasma generation electrode modules of FIG. 3C.

FIG. 3C is an overall schematic view of the unit plasma generation electrode module M1, and FIG. 3D is a schematic view of the plasma generation electrode assembly A1 formed by weaving the unit plasma generation electrode modules M1 of FIG. 3C.

The unit plasma generation electrode module M1 illustrated in FIG. 3C may be understood as the first flexible electrode unit M11 and the second flexible electrode unit M12. That is, the plasma generation electrode assembly A1 of FIG. 3D is formed by a pair of first and second flexible electrode units M11 and M12 formed to be the same, and in FIG. 3, it is illustrated that the first and second flexible electrode units M11 and M12 are woven to be perpendicular to each other.

In an exemplary embodiment of the present disclosure, the plasma generation electrode assembly may be formed in a manner of making cloth by interlacing threads, and a method thereof is not particularly limited.

Another exemplary embodiment will be described with reference to FIGS. 4A through 4D as follows.

Figure 4A:
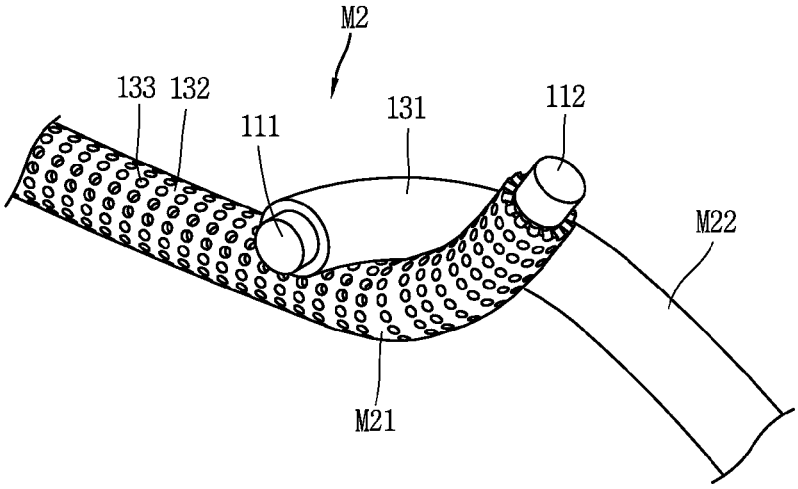
FIG. 4A is a schematic view of a unit plasma generation electrode module according to an exemplary embodiment of the present disclosure.
Figure 4B:
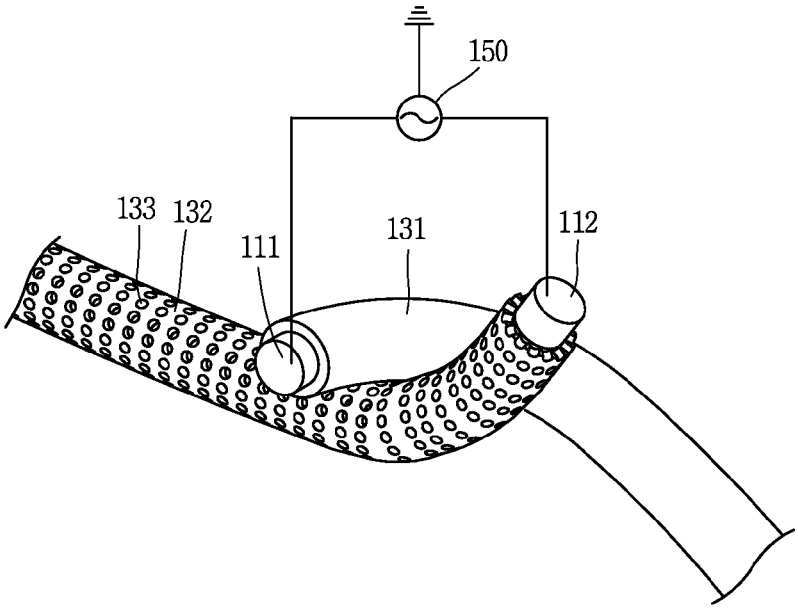
FIG. 4B is a view illustrating generation of plasma using the unit plasma generation electrode module of FIG. 4A.

FIG. 4A is a schematic view of a unit plasma generation electrode module according to an exemplary embodiment of the present disclosure, and FIG. 4B is a view illustrating generation of plasma using the unit plasma generation electrode module of FIG. 4A.

A first electrode 111 forming the plasma generation electrode module M2 in FIGS. 4A and 4B has a shaft shape, and a first dielectric material 131 is formed to surround an outer circumference of the first electrode 111. Also, a second electrode 112 is formed to have the same shaft shape as that of the first electrode 111, and a second dielectric material 132 is formed to surround an outer circumference of the second electrode 112. That is, the first dielectric material 131 surrounding the outer circumference of the first electrode 111, and the second dielectric material 132 are alternately interlaced so as to be integrally formed.

When a combination of the first electrode 111 and the first dielectric material 131 is called a first electrode unit M21, and a combination of the second electrode 112 and the second dielectric material 132 is called a second electrode unit M22, the plasma generation electrode module M2 are formed by alternately interlacing the first and second electrode units M21 and M22.

Here, a plurality of through holes 133 are formed in any one of the first dielectric material 131 and the second dielectric material 132 to emit generated plasma outwardly. The through holes 133 may be formed on both of the first and second dielectric materials 131 and 132. In this case, however, since a problem such as generation of a spark due to failure of properly insulating the mutually attached first and second electrodes 111 and 112 may arise, preferably, the fine through holes 133 are formed on only either of the first dielectric material or the second dielectric material 132. Even in this case, the dielectric materials 131 and 132 may perform a function of the covers 121 and 122 of FIG. 2.

Figure 4C:
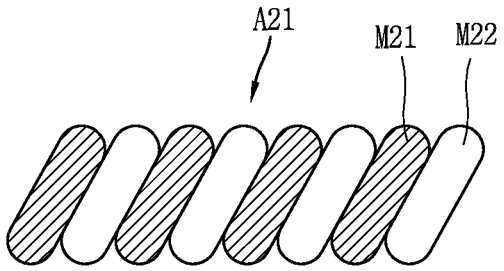
FIGS. 4C and 4D are schematic views of plasma electrode assemblies formed by unit plasma generation electrode modules.
Figure 4D:
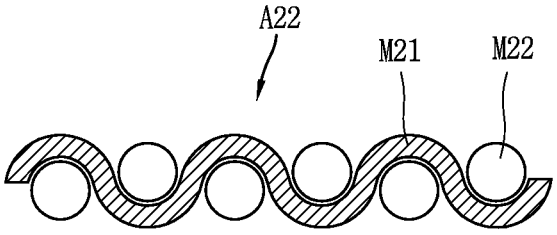

FIGS. 4C and 4D are schematic views of plasma electrode assemblies A21 and A22 formed by unit plasma generation electrode modules. As illustrated in FIGS. 4C and 4D, the flexible plasma generation electrode assemblies A21 and A22 may be formed by weaving a plurality of unit plasma generation electrode modules M2 illustrated in FIGS. 4A and 4B.

FIG. 4C illustrates the plasma generation electrode assembly A21 formed by spirally interlacing the first and second electrode units M21 and M22, and FIG. 4D illustrates the plasma generation electrode assembly A22 formed by interlacing the first and second electrode units M21 and M22 to be perpendicular to each other.

The plasma generation electrode assembly A22 illustrated in FIG. 4D as a shape similar to that of the plasma generation electrode assembly A21 illustrated in FIG. 3D. However, in FIG. 3C, the plasma generation electrode module M1 has a single form, while in FIG. 4D, the plasma generation electrode module M2 is formed by first and second different electrode units M21 and M22. That is, in the plasma generation electrode module in FIGS. 3A through 3D, the first dielectric material 131 is disposed on the outer circumference of the first electrode, the second electrode 112 is disposed to surround the outer circumference of the first dielectric material 131, and a plurality of through holes 113 are formed on the second electrode 112. In addition, the second dielectric material 132 including the through holes 133 may be provided on the outer circumference of the second electrode 112.

Figure 5A:
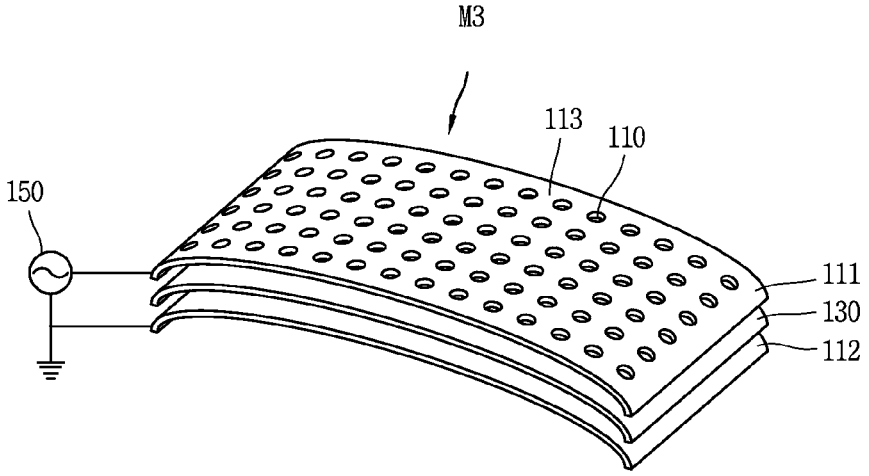
FIG. 5A is a view illustrating a unit plasma generation electrode module and generation of plasma using the unit plasma generation electrode module according to an exemplary embodiment of the present disclosure.
Figure 5B:
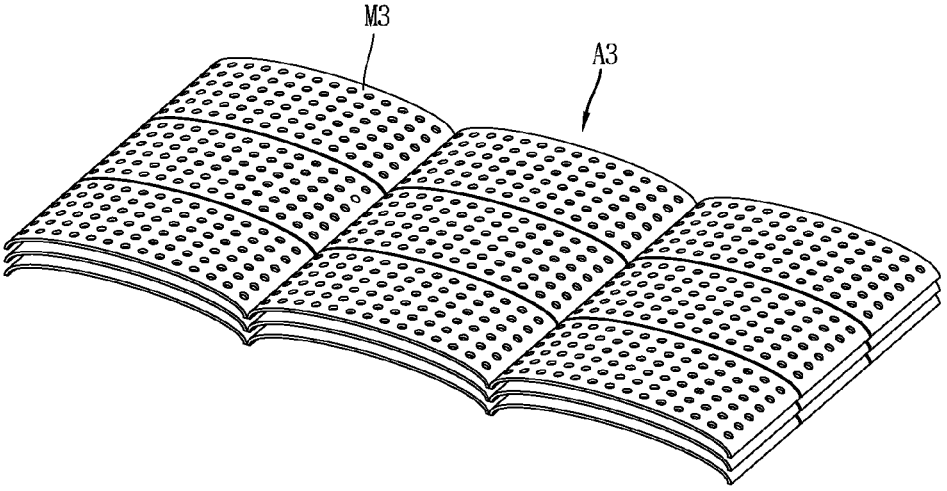
FIG. 5B is a schematic view of a plasma electrode assembly formed by the unit plasma generation electrode modules of FIG. 5A.

FIG. 5A is a view illustrating a unit plasma generation electrode module M3 and generation of plasma using the unit plasma generation electrode module according to an exemplary embodiment of the present disclosure, and FIG. 5B is a schematic view of a plasma electrode assembly A3 formed by the unit plasma generation electrode modules of FIG. 5A.

As illustrated in FIG. 5A, a plurality of through holes 113 may be formed on the first electrode 111 or the second electrode 112. In this case, unlike the case of FIG. 1, the first and second covers 121 and 122 may be omitted. Also, the plurality of through holes 113 may be formed on both of the first electrode 111 and the second electrode 112. In this case, however, plasma may be dispersed to reduce a sterilization or detoxification effect, and thus, preferably, the through holes 113 may be formed only any one of the first electrode 111 and the second electrode 112.

Here, in FIGS. 5A and 5B, the first and second electrodes 111 and 112 and the first and second dielectric materials 131 and 132 are formed to have a plate shape.

Also, as illustrated in FIG. 5B, the plurality of plasma generation electrode modules M3 may be arranged to be adjacent to each other to form the plasma generation electrode assembly A3.

Figure 6A:
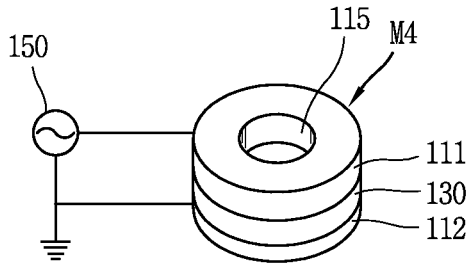
FIG. 6A is a view illustrating a unit plasma generation electrode module and generation of plasma using the unit plasma generation electrode module according to an exemplary embodiment of the present disclosure.

FIG. 6A is a view illustrating a unit plasma generation electrode module and generation of plasma using the unit plasma generation electrode module according to an exemplary embodiment of the present disclosure. In an exemplary embodiment of the present disclosure, a dielectric material 130 is disposed below a circular cylindrical first electrode 111 including a through hole 115, and a second electrode 112 having a circular plate shape may be disposed below the dielectric material 130.

That is, the plasma generation electrode module M4 in FIG. 6A has a cylindrical shape in which a hole is formed therein by the first and second electrodes 111 and 112 and the dielectric material 130.

Figure 6B:
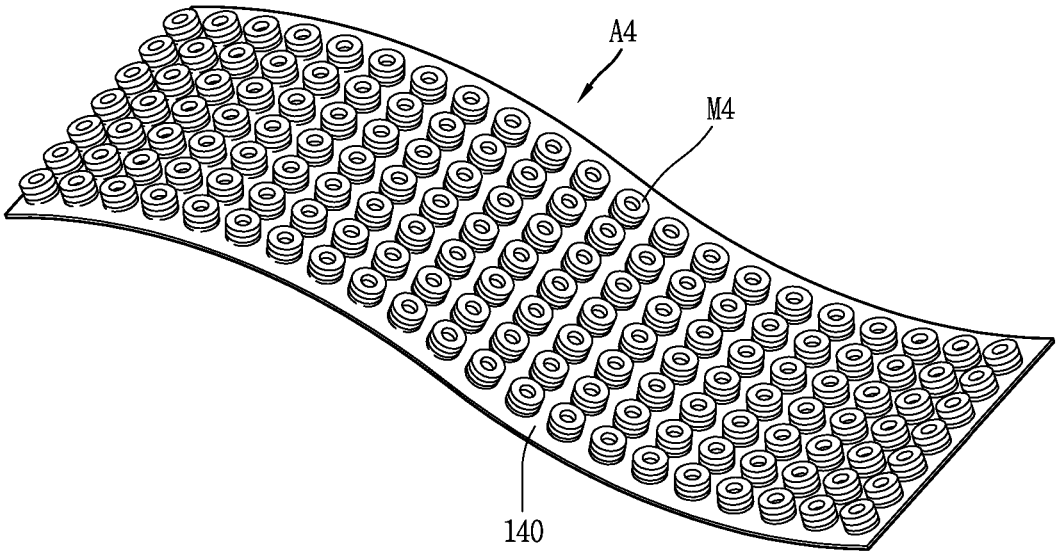
FIG. 6B is a schematic view of a plasma electrode assembly formed by the unit plasma generation electrode modules of FIG. 6A.

FIG. 6B is a schematic view of the plasma electrode assembly A4 formed by the unit plasma generation electrode modules M4 of FIG. 6A. Here, the plasma electrode assembly A4 may be formed by arranging the micro-scale unit plasma generation electrode modules M4 on a flexible member 140. Plasma generated in this case is discharged outwardly through the through hole 115. In this case, the unit plasma generation electrode modules M4 may not be flexible.

Each of the unit plasma generation electrode modules M4 is connected to the power supply unit 150 and individually controlled. This is the same in other exemplary embodiments. A plasma generation region may be controlled in the plasma generation electrode assemblies A1, A21, A22, A3, and A4 formed by arranging a plurality of unit plasma generation electrode modules M1, M2, M3, and M4. For example, in a case where the plasma generation electrode assembly A4 is greater than a sample to be detoxificated or sterilized, plasma may be generated only by a portion fitting a size of the sample. This is the same in other exemplary embodiments.

The shape of the plasma generation electrode module described above is merely an example and the present disclosure is not limited thereto.

As illustrated in FIGS. 3A through 6B, plasma generation electrodes may be variously combined or arranged so as to be manufactured. Structures of the electrodes are formed by modifying the structure of the DBD, and the electrodes are formed of a flexible material so as to be curved or bent. Also, as illustrated in FIG. 6, the micro-scale unit plasma generation electrode modules may be bonded to the flexible member 140 to perform discharge.

In an exemplary embodiment of the present disclosure, the plasma generating apparatus 100 generating plasma by using the plasma generation electrode modules described above is proposed.

The plasma generating apparatus 100 according to an exemplary embodiment of the present disclosure includes the power supply unit 150 applying power to the first and second electrodes 111 and 112 of the plasma generation electrode modules M1, M2, M3, and M4, or the plasma generation electrode assemblies A1, A21, A22, A3, and A4. The power supply unit 150 supplies a voltage to the electrodes 111 and 112, and in this case, the power supply unit 150 uses power having a frequency ranging from tens of kHz to hundreds of MHz. In addition, plasma may be discharged by using power having a frequency of a few GHz.

For simple atmospheric pressure discharge, preferably, power having a frequency ranging from 20 to 70 kHz is used. Since power having a high frequency is used, electromagnetic waves may be radiated, and in an exemplary embodiment of the present disclosure, in order to block electromagnetic waves, an electromagnetic wave shielding grid 125 for blocking electromagnetic waves may be attached to the surfaces of the covers 121 or 122.

In addition, plasma generated by the first and second electrodes 111 and 112 includes active oxygen or active nitrogen, and the plasma generating apparatus 100 further includes a plasma control unit (not shown) for controlling active oxygen and active nitrogen.

The plasma control unit is provided between the first and second electrodes 111 and 112 and the first and second covers 121 and 122, and serves to control active oxygen species or active nitrogen species formed by generated plasma to thereby enhance efficiency of detoxification or sterilization. When the plasma generating apparatus 100 is used in other application industry, efficiency of power may be enhanced and damage to a surface of a sample desired to be treated may be prevented.

Also, the plasma generating apparatus 100 according to an exemplary embodiment of the present disclosure includes a plasma diagnosing unit 170.

The plasma diagnosing unit includes various sensors 160, a probe, and the like. For example, the plasma diagnosing unit 170 includes a sensor for quantitatively analyzing various chemical species (ozone, nitrogen species, and other chemical species) generated when atmospheric pressure plasma is generated, a sensor for measuring a gas temperature of plasma, a plasma emission light diagnostor, a current and voltage measurement probe, and the like. Here, physical/chemical characteristics measured by the sensor 160 of the plasma diagnosing unit 170 may be monitored through an externally controlled computer. Thus, whether plasma is normally generated may be diagnosed. In this manner, whether plasma is normally generated and physical and chemical characteristics of plasma may be diagnosed by the plasma diagnosing unit 170.

Figure 7:
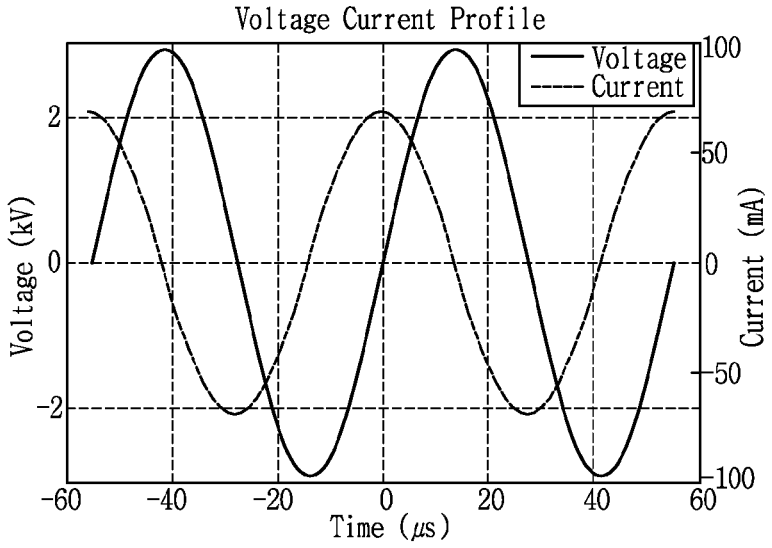
FIG. 7 is a view illustrating a graph of profiles of a current and a voltage over the passage of time measured by a plasma diagnosing unit according to an exemplary embodiment of the present disclosure.
Figure 8:
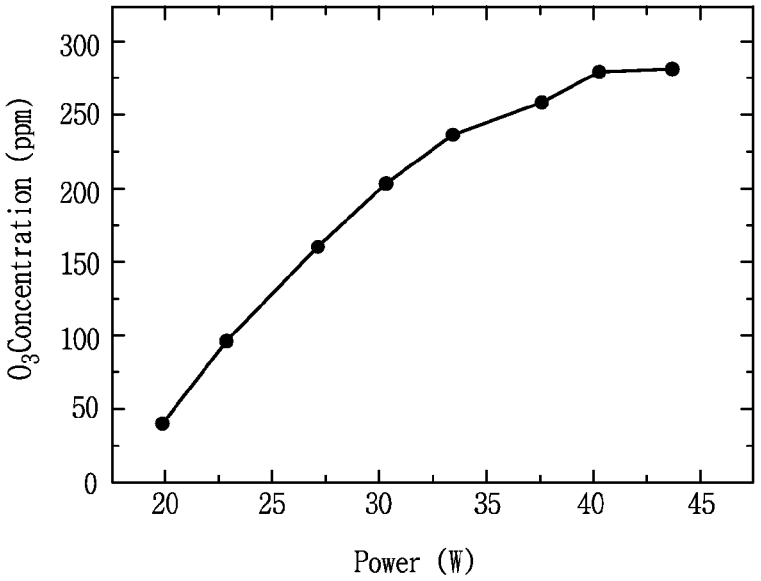
FIG. 8 is a graph illustrating concentration of ozone measured by the plasma diagnosing unit according to an exemplary embodiment of the present disclosure, in which various chemical species are sensed by attaching various chemical species sensors.
Figure 9:
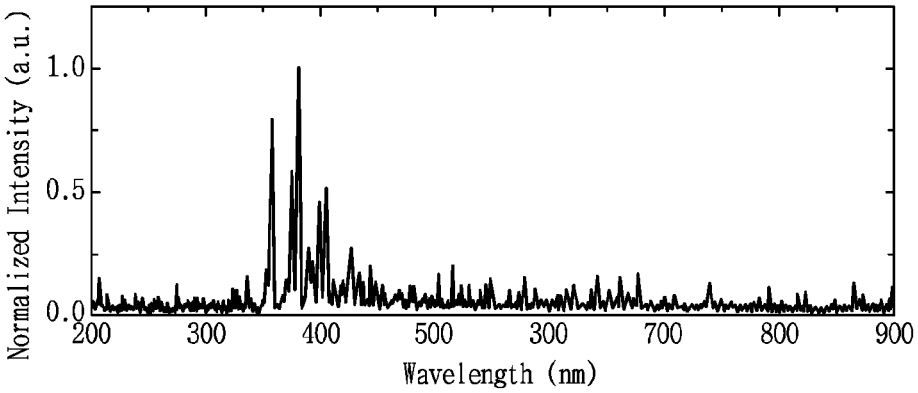
FIG. 9 is a graph illustrating emission light measured by the plasma diagnosing unit according to an exemplary embodiment of the present disclosure.

FIG. 7 is a view illustrating a graph of profiles of a current and a voltage over the passage of time measured by a diagnosing module according to an exemplary embodiment of the present disclosure, FIG. 8 is a graph illustrating concentration of ozone measured by the diagnosing module according to an exemplary embodiment of the present disclosure, and FIG. 9 is a graph illustrating emission light measured by the diagnosing module according to an exemplary embodiment of the present disclosure.

Also, the plasma generating apparatus 100 according to an exemplary embodiment of the present disclosure may further include a light source (not shown) for irradiating ultraviolet rays to a surface of a sample. The light source may irradiate ultraviolet rays to perform ultraviolet sterilization, increasing a sterilization effect. The light source may be a light emitting diode (LED), and detoxification and sterilization capability of plasma may be enhanced using the ultraviolet LED.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A plasma generation electrode module comprising:

a unit plasma generation electrode module configured to generate plasma comprising first and second electrodes formed to be spaced apart from one another; and a dielectric disposed between the first and second electrodes to insulate the first and second electrodes, wherein the first electrode has a shaft shape, a first cylindrical dielectric is formed to be in concentric with the first electrode so as to be in contact with an outer circumference of the first electrode and cover the first electrode, and the second electrode is formed to be in concentric with the first dielectric so as to be in contact with an outer circumference of the first dielectric and cover the first dielectric, wherein a second dielectric is formed to be in concentric with the second electrode on an outer circumference of the second electrode so as to be in contact with the outer circumference of the second electrode, and is formed of a member having air permeability, wherein a plurality of through holes are disposed on the second electrode to emit the generated plasma outwardly; and wherein the unit plasma electrode module is formed to be woven.

2. The plasma generation electrode module of claim 1, wherein the first and second electrodes are provided as conductive thin films.

3. The plasma generation electrode module of claim 1, wherein a photocatalyst or an active catalyst is coated on one or more of the first and second electrodes.

4. A plasma generation electrode module comprising:

first and second electrodes formed to be spaced apart from one another; and a dielectric disposed between the first and second electrodes to insulate the first and second electrodes, wherein the first electrode has a shaft shape, a first dielectric is formed to be in concentric with the first electrode to cover an outer circumference of the first electrode, the second electrode has a shaft shape and is interlaced with the first electrode, wherein a second dielectric is formed to be in concentric with the second electrode to cover an outer circumference of the second electrode, and the first and second dielectrics are in contact with each other, and a plurality of through holes are formed in the first dielectric.

5. A plasma generation electrode assembly comprising:

a first flexible electrode unit comprising at least one unit plasma generation electrode module; and a second flexible electrode unit formed to be spaced apart from the first flexible electrode unit comprising at least one unit plasma generation electrode module, wherein the unit plasma generation electrode module includes first and second electrodes formed to be spaced apart from one another and a dielectric disposed between the first and second electrodes to insulate the first and second electrodes, wherein the first electrode has a shaft shape, a first cylindrical dielectric is formed to be in concentric with the first electrode so as to be in contact with an outer circumference of the first electrode and cover the first electrode, and the second electrode is formed to be in concentric with the first dielectric so as to be in contact with an outer circumference of the first dielectric and cover the first dielectric, wherein a second dielectric is formed to be in concentric with the second electrode on an outer circumference of the second electrode so as to be in contact with the outer circumference of the second electrode, and is formed of a member having air permeability, wherein the first and second flexible electrode units are woven to be flexible, and wherein the second dielectric is formed of a material having air permeability, wherein the unit plasma generation electrode modules are individually controlled based on a size of the sample to be detoxificated or sterilized.

6. The plasma generation electrode assembly of claim 5, wherein a second dielectric is formed to be in concentric with the second electrode on an outer circumference of the second electrode so as to be in contact with the outer circumference of the second electrode, and wherein a plurality of through holes are disposed on the second electrode to outwardly emit a plasma generated on the first dielectric when power is applied to the first and second electrodes.

7. The plasma generation electrode assembly comprising:

a first flexible electrode unit;

a second flexible electrode unit formed to be spaced apart from the first flexible electrode unit, wherein the first flexible electrode includes a first electrode having a shaft shape and a first dielectric formed be concentric with the first electrode to cover an outer circumference of the first electrode, the second flexible electrode includes a second electrode having a shaft shape and a second dielectric formed to be in concentric with the second electrode to cover an outer circumference of the second electrode, the first and second flexible electrode units are disposed to interlace with each other, and a plurality of through holes are formed in any one of the first dielectric and the second dielectric.

8. A plasma generation electrode assembly comprising:

a first electrode;

a second electrode formed to be spaced apart from the first electrode; and a plurality of unit plasma generation electrode modules including a dielectric disposed between the first electrode and the second electrode to insulate the first electrode and the second electrode, wherein the first electrode has a circular cylindrical shape with a through hole, the second electrode is a circular plate, and the plurality of unit plasma generation electrode modules are formed in a flexible member.

9. A plasma generating apparatus comprising:

a plasma generation electrode assembly of claim 5;

a power supply unit configured to apply power to the first and second electrodes; and a plasma control unit configured to control active oxygen and active nitrogen included in plasma generated by the first and second electrodes.

10. The plasma generating apparatus of claim 9, further comprising:

a light source configured to irradiate ultraviolet rays.

11. The plasma generating apparatus of claim 9, wherein a plasma diagnosing unit is connected to the first and second electrodes to diagnose whether plasma is normally generated.

12. The plasma generating apparatus of claim 9, further comprising:

first and second covers disposed outside of the first and second electrodes, wherein a plurality of fine holes are formed on any one of the first and second covers.

13. The plasma generating apparatus of claim 12, wherein an electromagnetic wave shielding grid shielding an electromagnetic wave is attached to at least one of the first cover and the second cover.

14. The plasma generating apparatus of claim 9, wherein the first and second dielectrics are any one of Teflon, silicon, glass fiber and polyimide.

15. A plasma generation electrode module comprising:

a unit plasma generation electrode module configured to generate plasma comprising first and second electrodes formed to be spaced apart from one another; and a dielectric disposed between the first and second electrodes to insulate the first and second electrodes, wherein the first electrode has a shaft shape, a first cylindrical dielectric is formed to be in concentric with the first electrode so as to be in contact with an outer circumference of the first electrode and cover the first electrode, and the second electrode is formed to be in concentric with the first dielectric so as to be in contact with an outer circumference of the first dielectric and cover the first dielectric, wherein a plurality of through holes are disposed on the second electrode to emit the generated plasma outwardly, and wherein the unit plasma generation electrode module is formed to be woven.

16. The plasma generation electrode module of claim 15, wherein a second dielectric is formed to be in concentric with the second electrode on an outer circumference of the second electrode so as to be in contact with the outer circumference of the second electrode, and is formed of a member having air permeability.

17. A plasma generation electrode assembly comprising:

a first flexible electrode unit including at least one unit plasma generation electrode module;

a second flexible electrode unit formed to be spaced apart from the first flexible electrode unit including at least one unit plasma generation electrode module, wherein the unit plasma generation electrode module includes first and second electrodes formed to be spaced apart from one another and a dielectric disposed between the first and second electrodes to insulate the first and second electrodes, wherein the first electrode has a shaft shape, the dielectric is formed to be in concentric with the first electrode so as to be in contact with an outer circumference of the first electrode and cover the first electrode, and the second electrode is formed to be in concentric with the dielectric so as to be in contact with an outer circumference of the dielectric and cover the dielectric, wherein the first and second flexible electrode units are woven to be flexible, and wherein the unit plasma generation electrode modules is individually controlled based on a size of the sample to be detoxificated or sterilized.

* * * * *